US005992284A

United States Patent [19]

Bucks

[11] Patent Number: 5,992,284

[45] Date of Patent: Nov. 30, 1999

[54] KNIFE AND CUTTING WHEEL FOR A FOOD PRODUCT SLICING APPARATUS

[75] Inventor: Brent L. Bucks, Valparaiso, Ind.

[73] Assignee: Urschel Laboratories Incorporated, Valparaiso, Ind.

[21] Appl. No.: 08/971,560

[22] Filed: Nov. 17, 1997

[51] Int. Cl.[6] ..... B26D 1/12

[52] U.S. Cl. ..... 83/663; 83/678

[58] Field of Search ..... 83/356.3, 592, 83/596, 663, 678, 676

[56] References Cited

U.S. PATENT DOCUMENTS

| | | | |
|---|---|---|---|
| 89,873 | 5/1869 | Leman et al. | 83/356.3 |
| 118,235 | 8/1871 | Harnish et al. | 83/356.3 |
| 142,580 | 9/1873 | Parker | 83/356.3 |
| 415,682 | 11/1889 | Parker | 83/356.3 |
| 419,364 | 1/1890 | Schoell | 83/356.3 |
| 547,488 | 10/1895 | Hunziker | 83/356.3 |
| 2,482,523 | 9/1949 | Urschel et al. . | |
| 2,665,723 | 1/1954 | Urschel et al. . | |
| 3,004,572 | 10/1961 | Urschel et al. . | |
| 3,139,128 | 6/1964 | Urschel et al. . | |
| 3,139,129 | 6/1964 | Urschel et al. . | |
| 3,623,525 | 11/1971 | Kieves | 83/356.3 X |
| 4,089,110 | 5/1978 | Rasco | 30/41.5 |
| 4,368,657 | 1/1983 | Pellaton | 83/356.3 |
| 4,683,790 | 8/1987 | Bittner | 83/356.3 |
| 4,813,317 | 3/1989 | Urschel et al. . | |
| 5,191,819 | 3/1993 | Hoshi | 83/676 X |
| 5,501,127 | 3/1996 | Stauber | 83/592 X |

FOREIGN PATENT DOCUMENTS

| | | | |
|---|---|---|---|
| 397305 | 6/1924 | Germany | 83/663 |
| 622683 | 5/1949 | United Kingdom | 83/356.3 |

OTHER PUBLICATIONS

3 Pages of Brochure from–Emura Food Machine Co., Ltd. entitled "Model Esa Wonderful! Sliced Food Coming Out In Order".

*Primary Examiner*—M. Rachuba
*Attorney, Agent, or Firm*—Bacon & Thomas, PLLC

[57] ABSTRACT

A knife and a cutting wheel are disclosed for a food product slicing apparatus. The knife has a gauging surface, a cutting edge and a second edge located opposite to the cutting edge, the second edge extending obliquely with respect to the cutting edge such that the knife has a generally triangular configuration. A plurality of such knives are mounted between a hub and a rim of the cutting wheel such that the knives extend generally radially from the hub and wherein the second edge and gauging surface form a juncture, which extends substantially parallel to the cutting edge of an adjacent knife blade to form a gate opening, the thickness of the gate opening accurately controlling the thickness of the sliced food product.

10 Claims, 11 Drawing Sheets

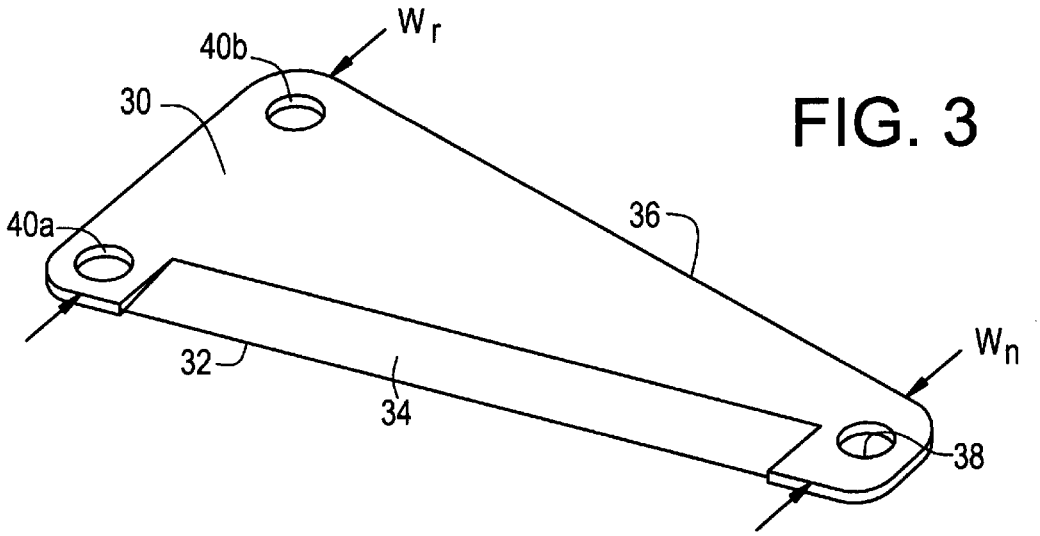
FIG. 3
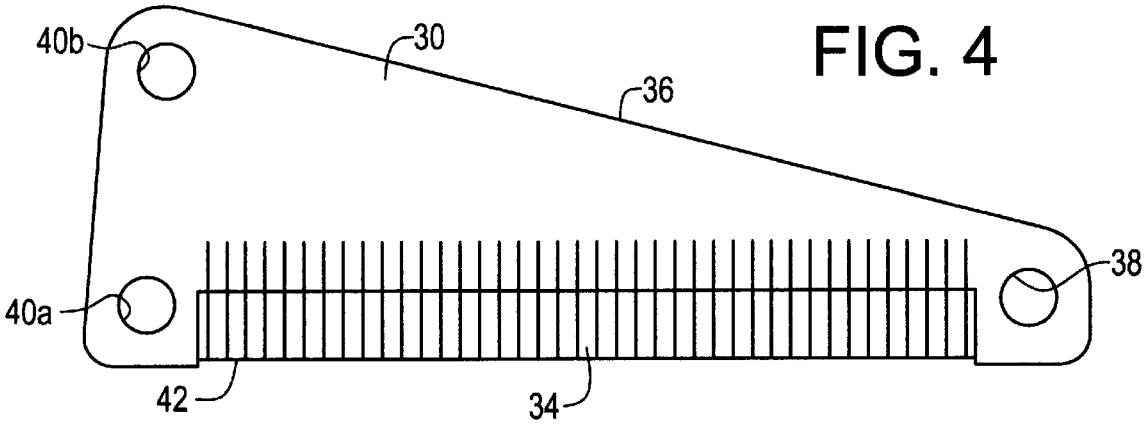
FIG. 4
FIG. 5
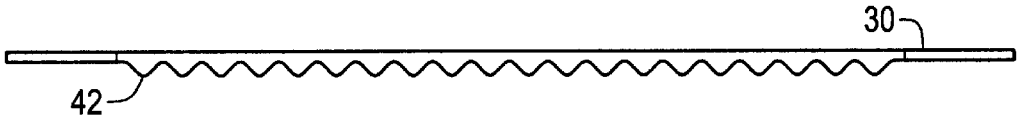
FIG. 6
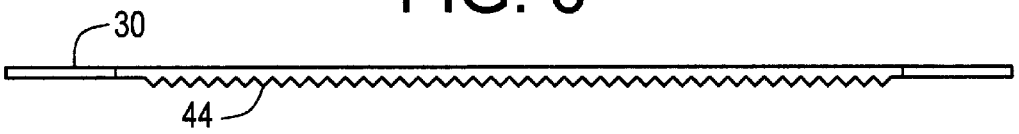

KNIFE AND CUTTING WHEEL FOR A FOOD PRODUCT SLICING APPARATUS

BACKGROUND OF THE INVENTION

The present invention relates to a knife and a cutting wheel for a food product slicing apparatus in which the thickness of the food slices may be accurately controlled and which enables the slicing apparatus to produce a higher quantity output.

Many types of food slicing apparatus are known in which a food product is transported into a rotating wheel having a plurality of cutting knives such that the food product is cut into slices. In the food processing industry, it is vitally important that the food product be cut into slices having a uniform thickness without damaging the food product. Such thickness uniformity facilitates the further processing of the food product giving a maximum amount of usable food product with a minimum amount of waste.

Broadly, food slicing devices comprise those having a rotating wheel in which a plurality of knives extend between a hub and a rim, and the food product is fed through the cutting plane of the rotating wheel, and those having a drum in which the circumference of the drum comprises a plurality of shoes, each shoe having a cutting knife thereon wherein the cutting edge of one shoe is spaced from a trailing edge of an adjacent shoe to control the thicknesses of the sliced food product. In the drumtype of cutting devices, the food product is fed into the interior of the drum onto a rotating base and is driven by paddles or blades on the base and by centrifugal force into contact with the stationary cutting knives. Generally speaking, controlling the consistency of the thickness of food products sliced with the rotating wheel device requires accurate coordination between the rotating speed of the wheel, the spacing between the blades of the wheel and the feed rate of the food product. The accurate control of all of these parameters results in a complex apparatus and these devices have not achieved the desired slice thickness accuracy and consistency at high production volumes.

The drum type of slicing apparatus accurately controls the thickness of the sliced food product, but cannot reach the desired high output volume without the possibility of damaging the food product. The output volume of these devices is limited by the rotational speed of the base, which must be limited to prevent possible damage to the food product by contact with the paddles or blades of the base. Another drawback associated with this type of slicing apparatus relates to the orientation of elongated food products. It is often desirable to slice an elongated food product either perpendicular to, or at an oblique angle relative to the longitudinal axis of the elongated food product. However, it is extremely difficult to properly orient elongated food products, which may have varying dimensions, both longitudinally and laterally, in the drum type of slicing apparatus in order to slice the food product in the desired orientation.

Typical, known cutting wheels are illustrated in FIGS. 1 and 2. A first type of known wheel illustrated in FIG. 1 comprises a hub 10, about which is concentrically arranged a rim 12, the hub and rim being interconnected by a plurality of knives 14. Each of the knives 14 has a cutting edge 16 facing in the direction of rotation of the wheel, indicated by arrow 18. The width W of each of the cutting knives 14 is relatively small thereby forming a radially extending space 20 between a trailing edge of one knife and the cutting edge of the adjacent knife having large dimensions in a circumferential direction. Not only is the space 20 between the knives relatively large, but the circumferential dimension of this space 20 is greater adjacent to the rim than adjacent to the hub.

A second type of known cutting wheel is illustrated in FIG. 2 wherein the hub 10 and the rim 12 are similar to the previously described cutting wheel, but cutting knives 22 have a greater width W. Again, the knives 22 each have a cutting edge 24 facing in the direction of rotation, illustrated by arrow 26. Although the radial space 28 between the cutting edge of one knife and a trailing edge of an adjacent knife is somewhat smaller than in the previously described known cutting wheel, the circumferential dimensions of the space 28 varies greatly between the rim and the hub.

Typically, the food product is transported through the cutting plane of the cutting wheel at a constant speed and the cutting wheel is rotated, also at a constant speed. The varying circumferential dimensions of the radial spaces 20 and 28 between the adjacent knives 14 and 24 render it difficult to achieve a desired high level of consistency in the thickness of the sliced food product.

SUMMARY OF THE INVENTION

A knife and a cutting wheel are disclosed for a food product slicing apparatus. The knife has a cutting edge and a second edge located opposite to the cutting edge, the second edge extending obliquely with respect to the cutting edge such that the knife has a generally triangular configuration. A plurality of such knives are mounted between a hub and a rim of the cutting wheel such that the knives extend generally radially from the hub and wherein the second edge forms a juncture with a gauging surface which juncture extends substantially parallel to the cutting edge of an adjacent knife blade to form a gate opening which accurately controls the thickness of the sliced food product.

The knife blade may be formed from a single piece with the cutting edge formed by a beveled edge portion on one side of the knife. The cutting edge may be a straight linear cutting edge, a convexly or concavely curved cutting edge, a curved cutting edge, or a series of curved or v-shaped portions to cut various forms of slices from the food product. Alternatively, the knife may comprise an assembly of a knife holder having the second edge, and a knife blade that is attached to the knife holder. Again, the knife blade may also have a straight linear cutting edge, a curved cutting edge, or the cutting edge may comprise a series of curved or v-shaped portions. The knife blade may have a series of smaller blades extending perpendicularly from the plane of the knife blade to shred a food product by cutting it into strips. The food product can also be shredded by radially displacing alternate ones of the curved or v-shaped knife blades around the cutting wheel. This places the curved or v-shaped portions out of radial alignment with corresponding portions on adjacent blades to form a shredded food product.

The single piece knife is attached to the hub and rim of the cutting wheel so as to be at a slight angle, or pitch, relative to the plane of rotation of the cutting wheel to establish the desired gate opening between the cutting edge of one blade and the second edge of an adjacent blade. This can be accomplished by forming mounting surfaces on the hub and the rim to which the knife is attached so as to impart a proper pitch angle to the knife. The pitch angle allows a constant uninterrupted feed rate of the food product as the knife passes through the food product to assist in the feeding of the food product and allows multiple knives to simultaneously engage the food product.

The knives attached to the cutting wheel (which rotates about a central axis and forms a cutting plane extending generally perpendicular to the central axis) each have a gauging surface that faces generally toward the direction from which the food product is fed into the cutting wheel and against which the food product bears as the knife passes through the food product. The feed path of the food product may be perpendicular or oblique with respect to the cutting plane. The gauging surface forms a juncture with the second edge of the knife and is oriented at a slight angle relative to the cutting plane of the cutting wheel to enable the food product to be accurately sliced by a cutting edge of the following knife located adjacent to the juncture. The gauging surface eliminates the need to coordinate the feeding speed of the food product and the rotational speed of the cutting wheel. The food product need only be fed fast enough to maintain contact with the gauging surfaces of the knives.

The knife and cutting wheel according to the present invention enable high volumes of food product to be accurately cut into slices having small thickness variations. The present invention achieves these beneficial results by using a gate opening between adjacent knives, the gate opening having a constant dimension between the hub and the rim, unlike the irregularly shaped space between adjacent knives in the prior art types of cutting wheels.

BRIEF DESCRIPTION OF THE DRAWINGS

FIG. 3 is a perspective view of a first embodiment of the knife according to the present invention.

FIG. 4 is a top view of a first variation of the knife illustrated in FIG. 3.

FIG. 5 is a front view of the knife of FIG. 4.

FIG. 6 is a front view of a second variation of the knife according to the present invention having a series of V-shapes along the cutting edge.

DETAILED DESCRIPTION OF THE PREFERRED EMBODIMENTS

Figure 1:
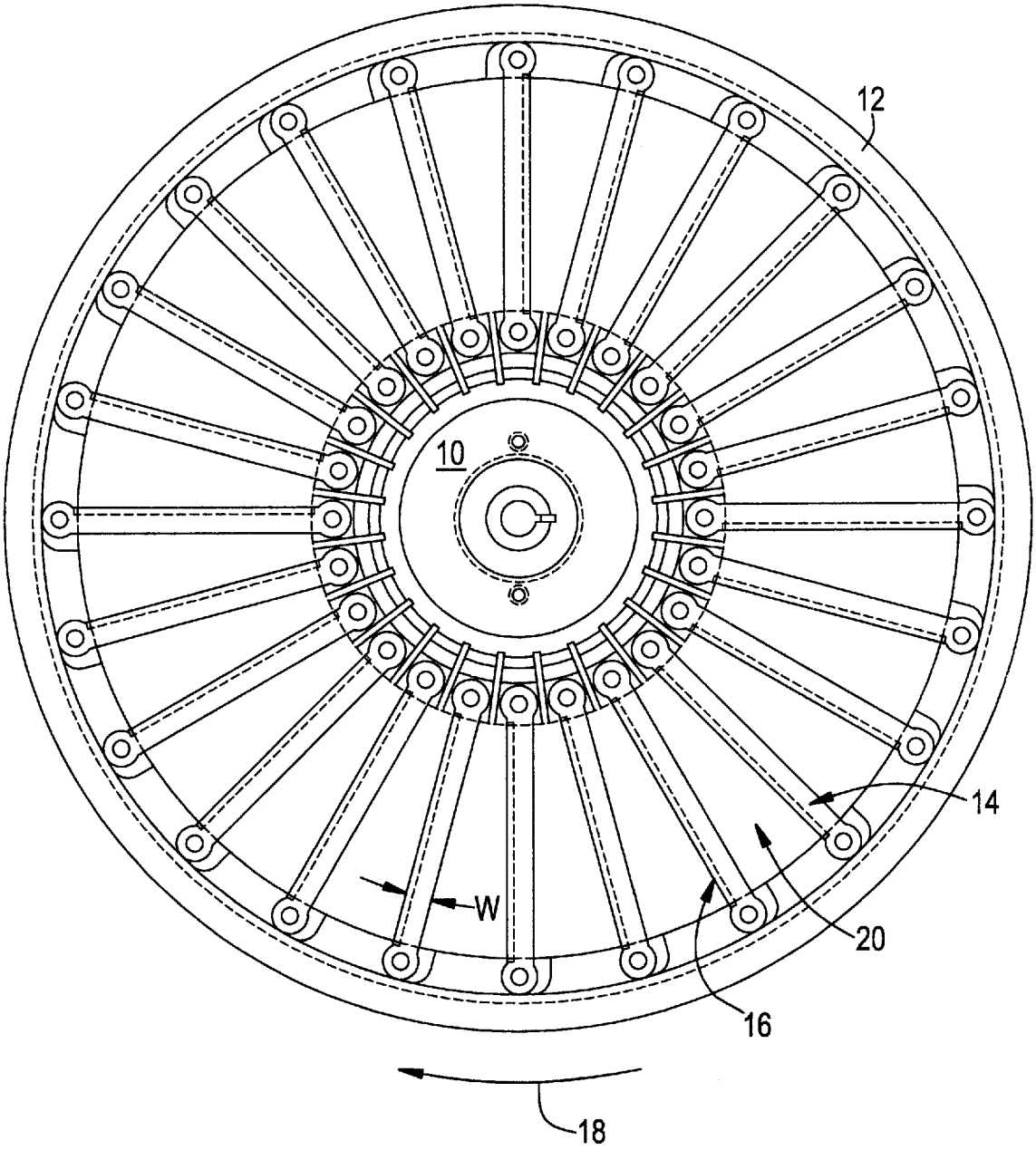
FIG. 1 PRIOR ART
FIG. 1 is a front view of a known type of cutting wheel.
Figure 2:
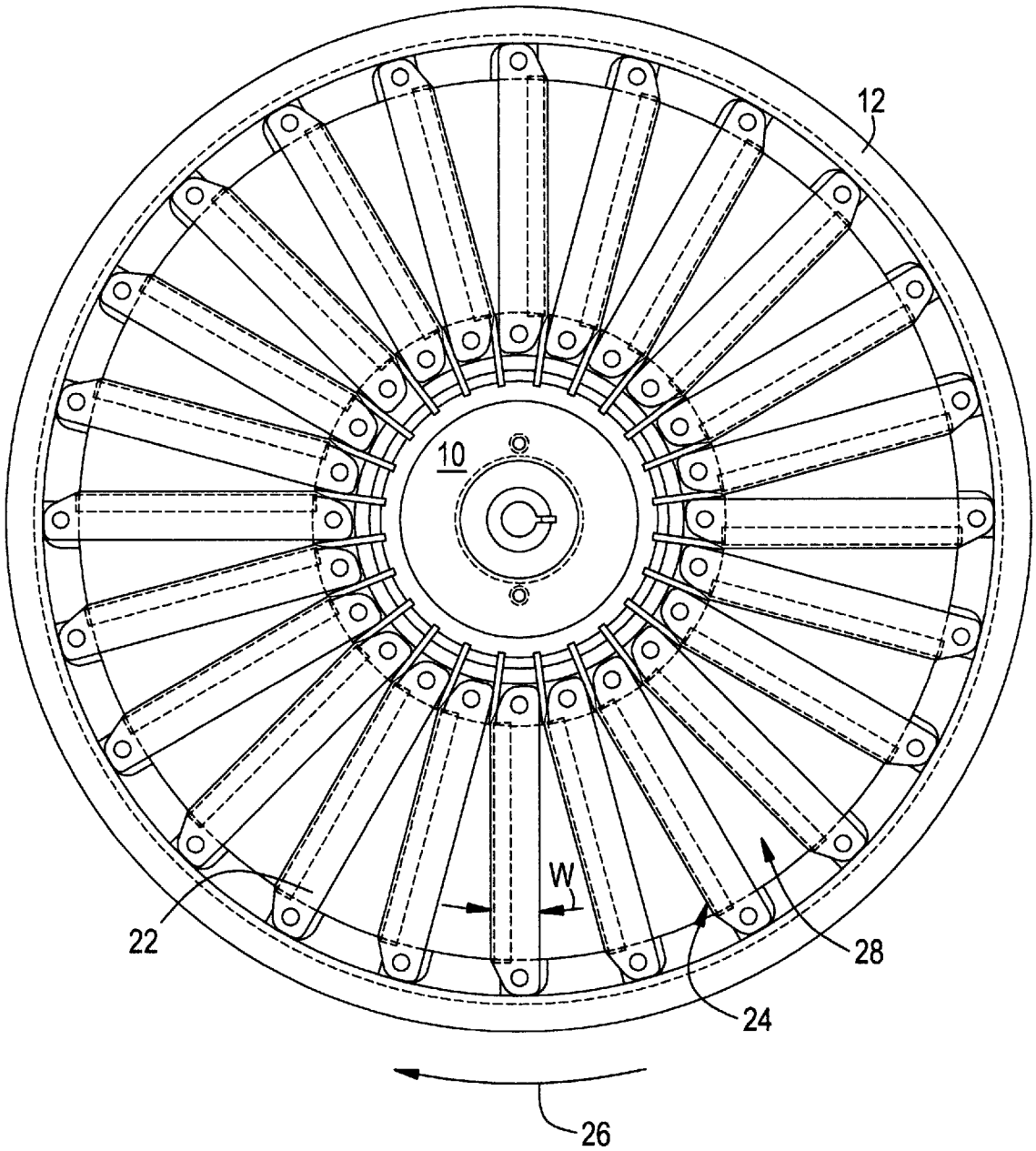
FIG. 2 PRIOR ART
FIG. 2 is a front view of another known type of cutting wheel.
Figure 7:
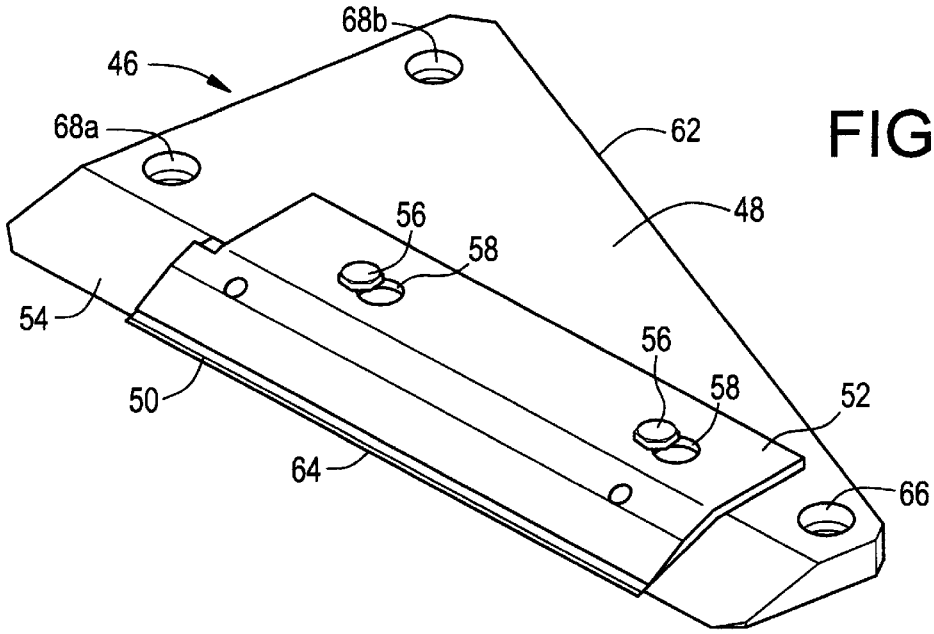
FIG. 7 is a perspective view of a second embodiment of a knife according to the present invention.
Figure 8:
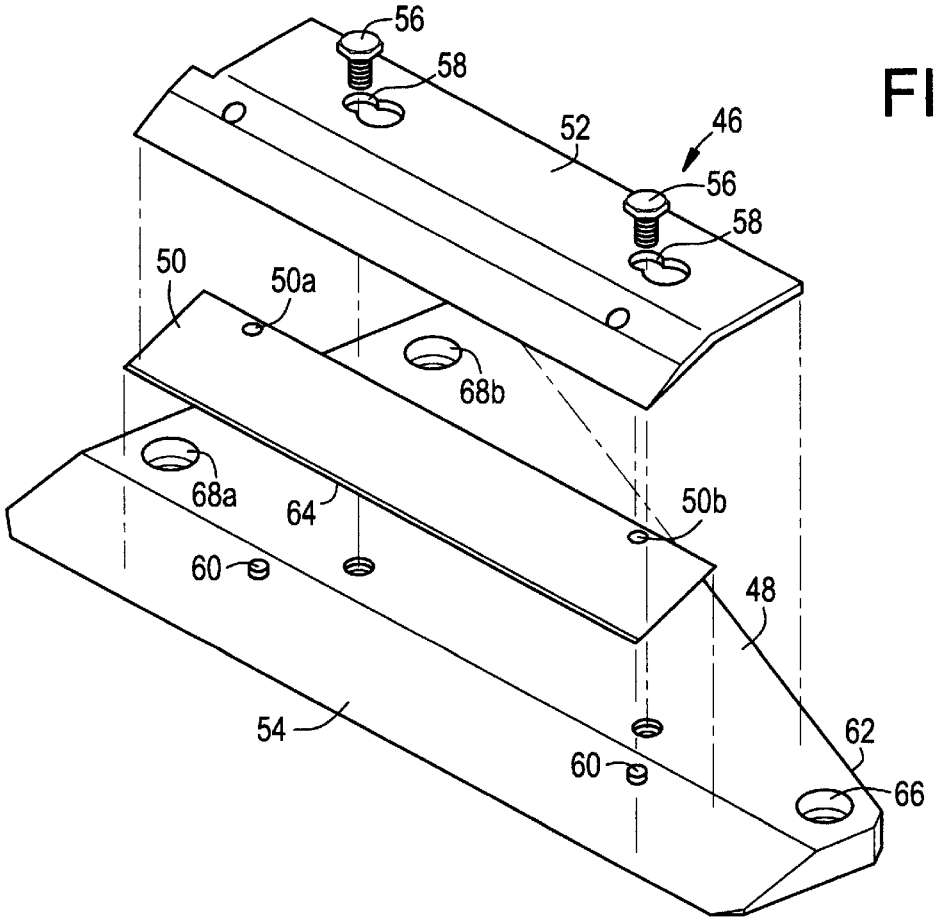
FIG. 8 is an exploded view of the knife illustrated in FIG. 7.
Figure 9:
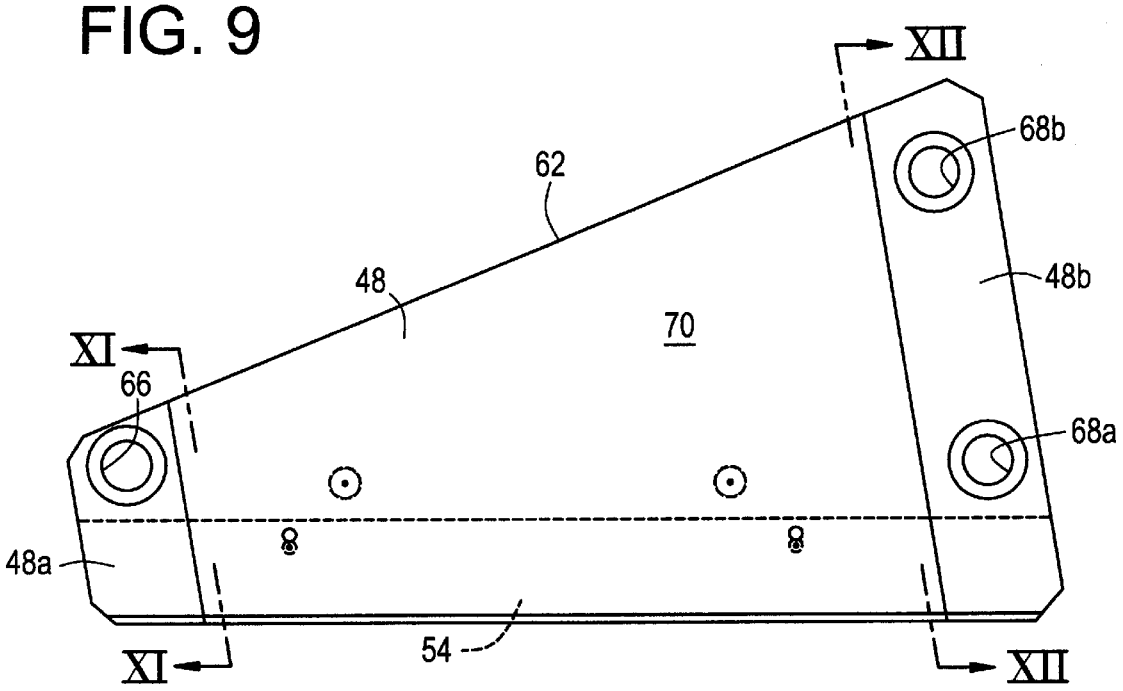
FIG. 9 is a bottom view of the knife holder utilized with the knife illustrated in FIG. 7.
Figure 10:
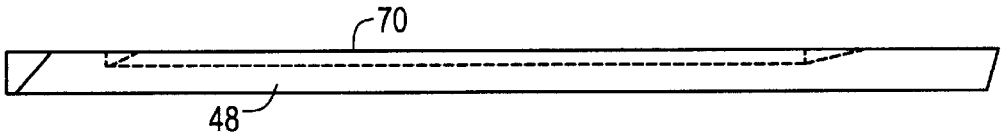
FIG. 10 is a front view of the knife holder illustrated in FIG. 9.

A first embodiment of the knife according to the present invention is illustrated in FIG. 3. The knife 30 is formed from a single, planar piece of material, such as by cutting, stamping, etc., and has a cutting edge 32 formed thereon by a beveled surface 34. Although a single bevel surface 34 is illustrated, it is to be understood that the cutting edge 32 could be formed by a double bevel or other known configuration without exceeding the scope of this invention. A second edge 36 is located opposite the cutting edge 32 and extends obliquely with respect to the cutting edge 32. A hub mounting hole 38 and rim mounting holes 40*a* and 40*b* are formed in opposite ends of the knife to attach the knife 30 to the hub and the rim of a cutting wheel. As can be seen, the width $W_h$ of the knife 30 at the hub end is less than the width $W_r$ of the blade at the rim end. This gives the knife 30 a generally triangular configuration. Except for the bevel surface 34, the thickness of the knife blade 30 is substantially constant throughout.

The knife illustrated in FIG. 3 has a straight, linear cutting edge 32 for cutting food product slices having planar opposite sides. The cutting edge 32 may be convexly or concavely curved, or may be modified to form food product slices having "wavy" opposite surfaces or "V-shaped" grooves in opposite surfaces. A first variation is illustrated in FIGS. 4 and 5 with the knife having the identical configuration to the knife illustrated in FIG. 3, except for the cutting edge. In this particular embodiment, the cutting edge 42 has a sinusoidal or "wavy" configuration extending along the length of the cutting edge comprising a series of curves having opposite curvatures. Blades of this configuration will form food product slices having "wavy" opposite major surfaces.

A second variation is illustrated in FIG. 6 wherein the cutting edge 44 comprises series of "V's" along the length of the cutting edge to form food product slices having V-shaped grooves in opposite major surfaces. When the knives are attached to a cutting wheel, the curves of cutting edge 42, or the "V's" of cutting edge 44 may be radially aligned with those of adjacent blades for forming appropriately shaped food slices. The cutting edges of alternative blades may also be formed or located such that the curves or "V's" of every other knife is out of radial alignment with adjacent knives if it is desired to form a shredded food product rather than a sliced food product.

An alternative embodiment of the knife according to the present invention is illustrated in FIGS. 7–12. As can be seen, the knife 46 comprises a knife holder 48 on which knife blade 50 is mounted. The knife blade may be permanently attached to the knife holder, or may be removably held by clamp 52. Knife blade 50 is held against bevel surface 54 formed on the knife holder 48 by clamp 52, which is attached to the knife holder by fasteners 56. Clamp 52 may engage the fasteners 56 by way of keyhole-shaped slots 58 which enable the removal of the clamp 52 by merely loosening the fasteners 56 and moving the clamp 52 such that the heads of the fasteners 56 are aligned with the larger opening portion of the keyhole shaped slots 58 and then removing the clamp 52. This eliminates the need to completely remove the fasteners 56 from the knife holder 48. Locating studs 60 extend from the knife holder 48 and engage openings 50*a* and 50*b* in the knife blade 50 to properly locate the knife blade 50 on the knife holder 48.

Knife holder 48 has second edge 62 formed thereon and, as can be seen, the second edge 62 extends obliquely with respect to the cutting edge 64 of the knife blade 50. Knife holder 48 has hub mounting hole 66 and rim mounting holes 68*a* and 68*b* formed therein for attachment to the hub and rim, respectively, of a cutting wheel. As can be seen, the width of the knife holder 48 at the hub mounting end is less than the width of the knife holder 48 at the rim mounting end, as in the previously described embodiment.

As in the previously described embodiment, knife blade 50 may have a convexly or concavely curved cutting edge, or the cutting edge may be formed in a series of curves to impart a sinusoidal or "wavy" configuration to the cutting edge, or the cutting edge may comprise a series of "V's" along its length. If the curves and "V's" are radially aligned, the cutting wheel on which the knife blades are used will slice the food product into slices having either "wavy" opposite major surfaces, or slices having V-shaped grooves in opposite major surfaces. If the curves, or "V's" of alternating blades are placed out of radial alignment with the corresponding curves or "V's" in adjacent blades, the cutting wheel on which the knife blades are mounted will shred the food product.

Figure 11:
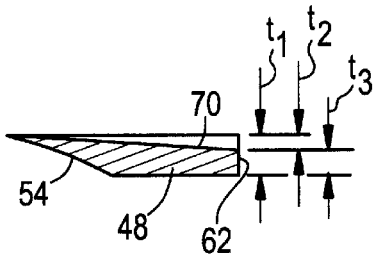
FIG. 11 is a cross-sectional view taken along line XI—XI in FIG. 9.
Figure 12:
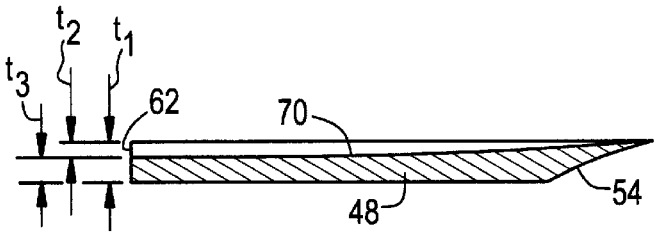
FIG. 12 is a cross-sectional view taken along line XII—XII in FIG. 9.

Knife holder 48 has a gauging surface on a side of the knife holder 48 which faces generally upstream of the direction of the food product travel towards the cutting wheel, the unsliced food product coming into contact with the gauging surface of the knife as the knife passes through the food product. As illustrated in FIGS. 9–12, the gauging surface 70 extends to the second edge 62 of the knife holder. The opposite end mounting portions 48*a* and 48*b* of the knife holder have a substantially constant thickness $t_1$ throughout their width, except for the portion on which the bevel surface 54 is located. The amount of taper of the gauging surface 70 at the second edge 62 is the same for both ends of the knife holder 48. This dimension, $t_2$ is illustrated in FIGS. 11 and 12. Since the total dimension of the taper at the second edge 62 is the same, the angle of taper for the gauging surface 70 at the hub end 48*a* of the knife holder will be greater than at the rim end 48*b*, since the same taper dimension must be achieved across a shorter width. The thickness $t_3$ of the knife holder 48 along the length of the second edge 62 is substantially constant. The gate opening is formed by the distance between a cutting edge 64 of one knife and the juncture of the gauging surface 70 and the edge 62 of an adjacent knife.

Figure 13:
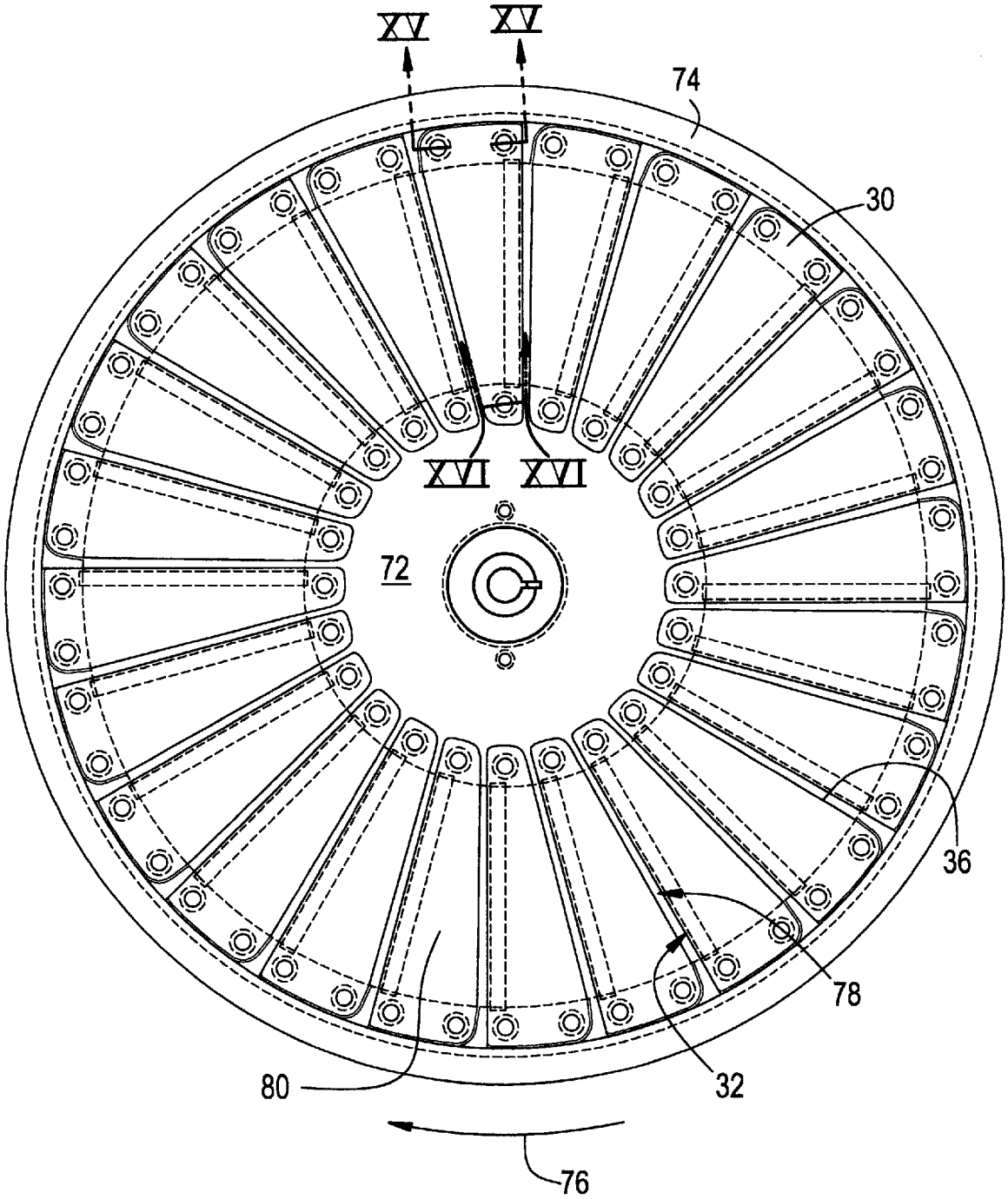
FIG. 13 is a front view of a cutting wheel according to the present invention utilizing the knives of FIG. 3.
Figure 14:
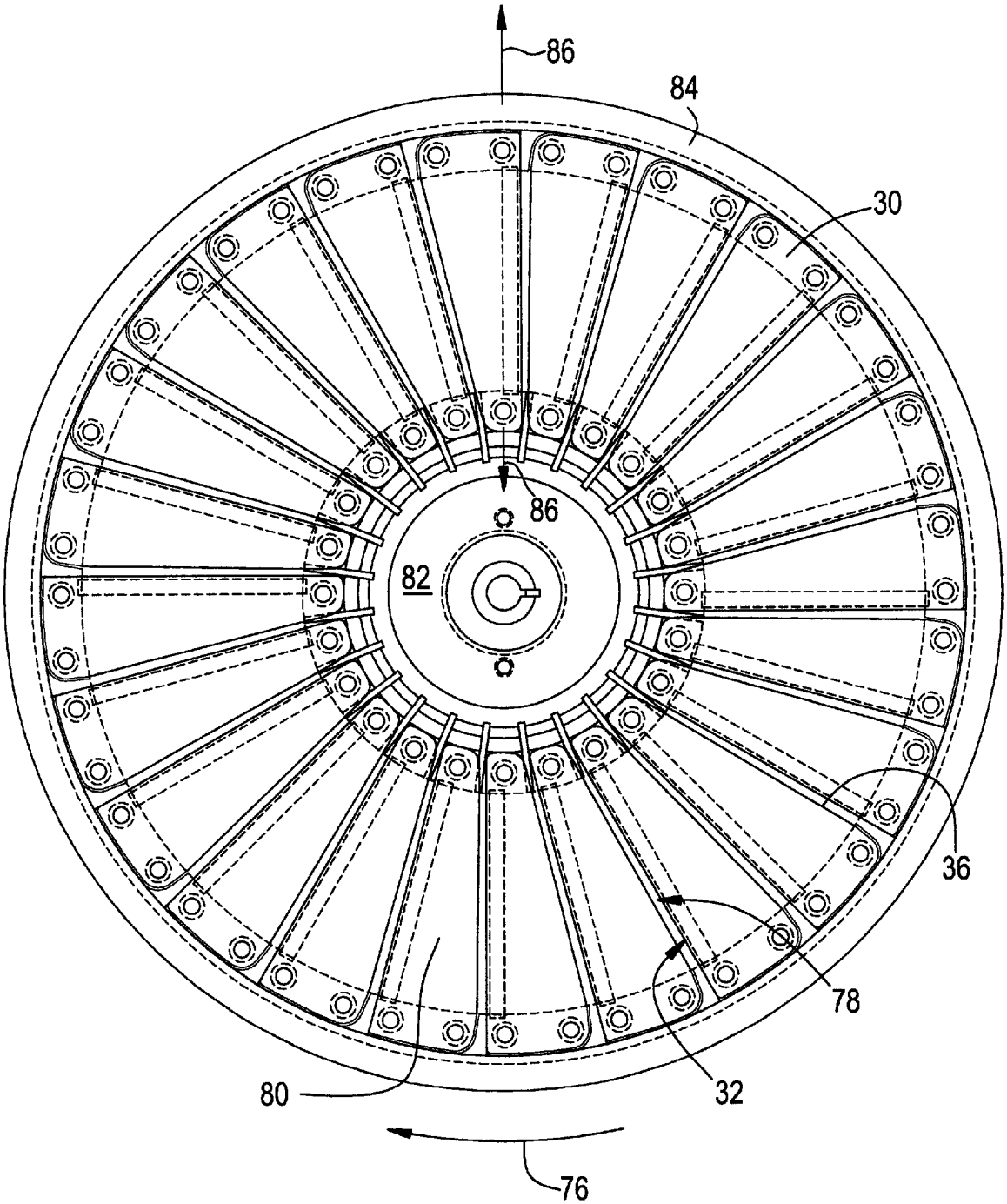
FIG. 14 is a front view of a tension head cutting wheel utilizing the knives illustrated in FIG. 3.

FIGS. 13 and 14 are front views of two types of cutting wheels according to the present invention on which are mounted a plurality of knives 30, as illustrated in FIG. 3. As can be seen, the first type of cutting wheel has a hub 72, a rim 74 and a plurality of blades 30 attached to the hub 72 and the rim 74. The cutting wheel rotates in the direction of arrow 76. The cutting edge 32 of each knife 30 is located adjacent to a second edge 36 of an adjacent knife 30. The second edge 36 extends substantially parallel to the cutting edge 32 of the adjacent knife 30 such that a radial space 78 is formed extending between the hub 72 and the rim 74 which has a constant circumferential dimension throughout its radial length. Unlike the known cutting wheels, the space 78 has a constant dimension throughout its length between the hub and the rim. In the views illustrated in FIGS. 13 and 14, the gauging surfaces 80 of each of the knives 30 can be seen. The food product is fed into the plane of the cutting wheel so as to maintain contact with the gauging surfaces of the knives as they pass through the food product. The dimension of the gate opening will accurately control the thickness of the sliced food product.

FIG. 14 illustrates the use of knives 30 on a cutting wheel having a hub 82 and a rim 84. The positioning and operation of the knives 30 is identical to the previously described embodiment, the only difference being that hub 82 comprises known means to apply a tension to the knives 30 in the direction of arrows 86. As in the previously described figure, the wheel rotates in the direction of arrow 76. Such tension hubs 82 are well-known in the art and need not be further described here. The tension forces exerted on the knife 30 will be exerted through the fasteners closest to the cutting edge, the second fastener on the rim end of the knife being used to clamp the trailing corner of the knife to the rim.

Figure 15:
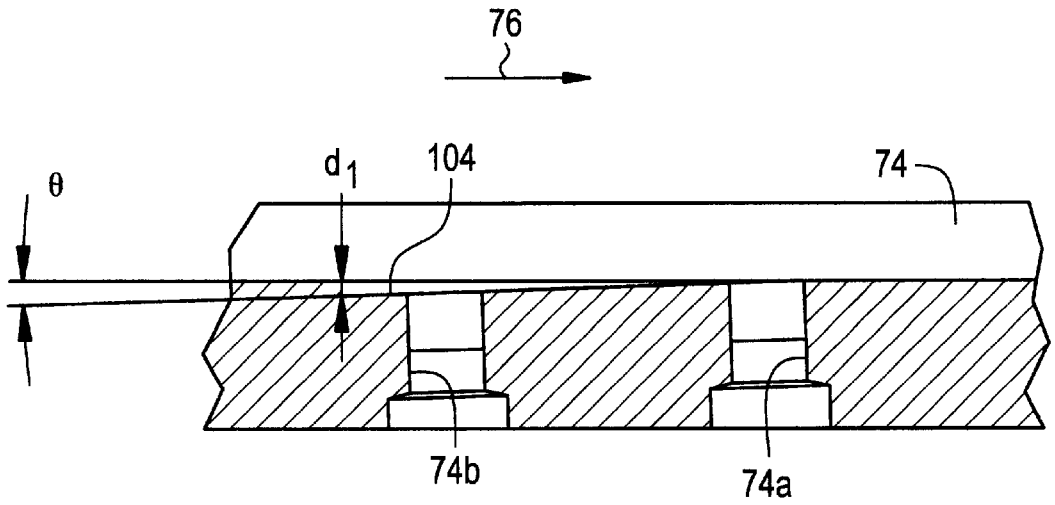
FIG. 15, is a cross-sectional view taken along line XV—XV in FIG. 13.
Figure 16:
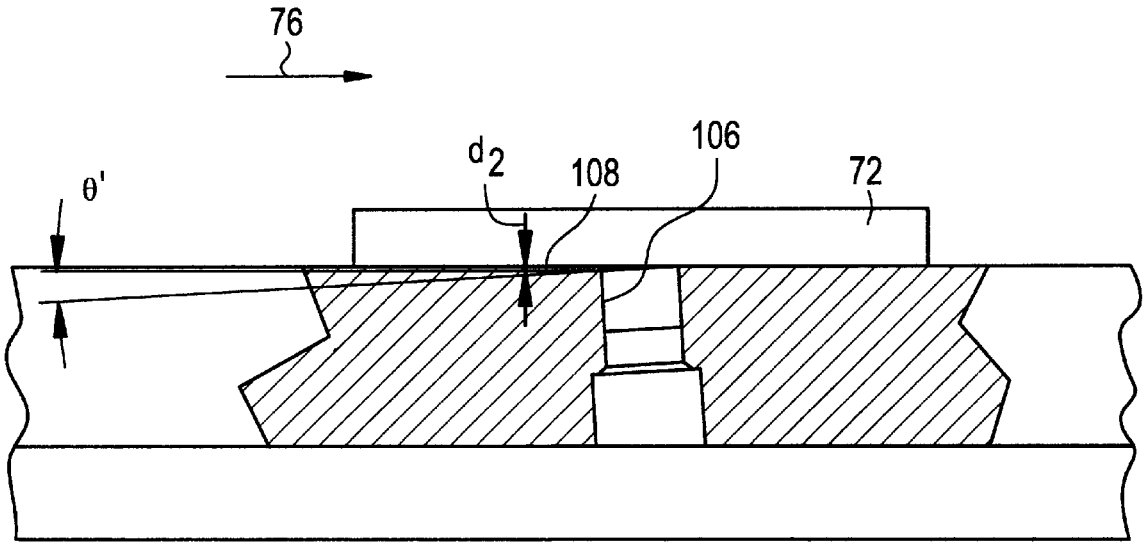
FIG. 16, is a cross-sectional view taken along line XVI—XVI in FIG. 13.
Figure 17:
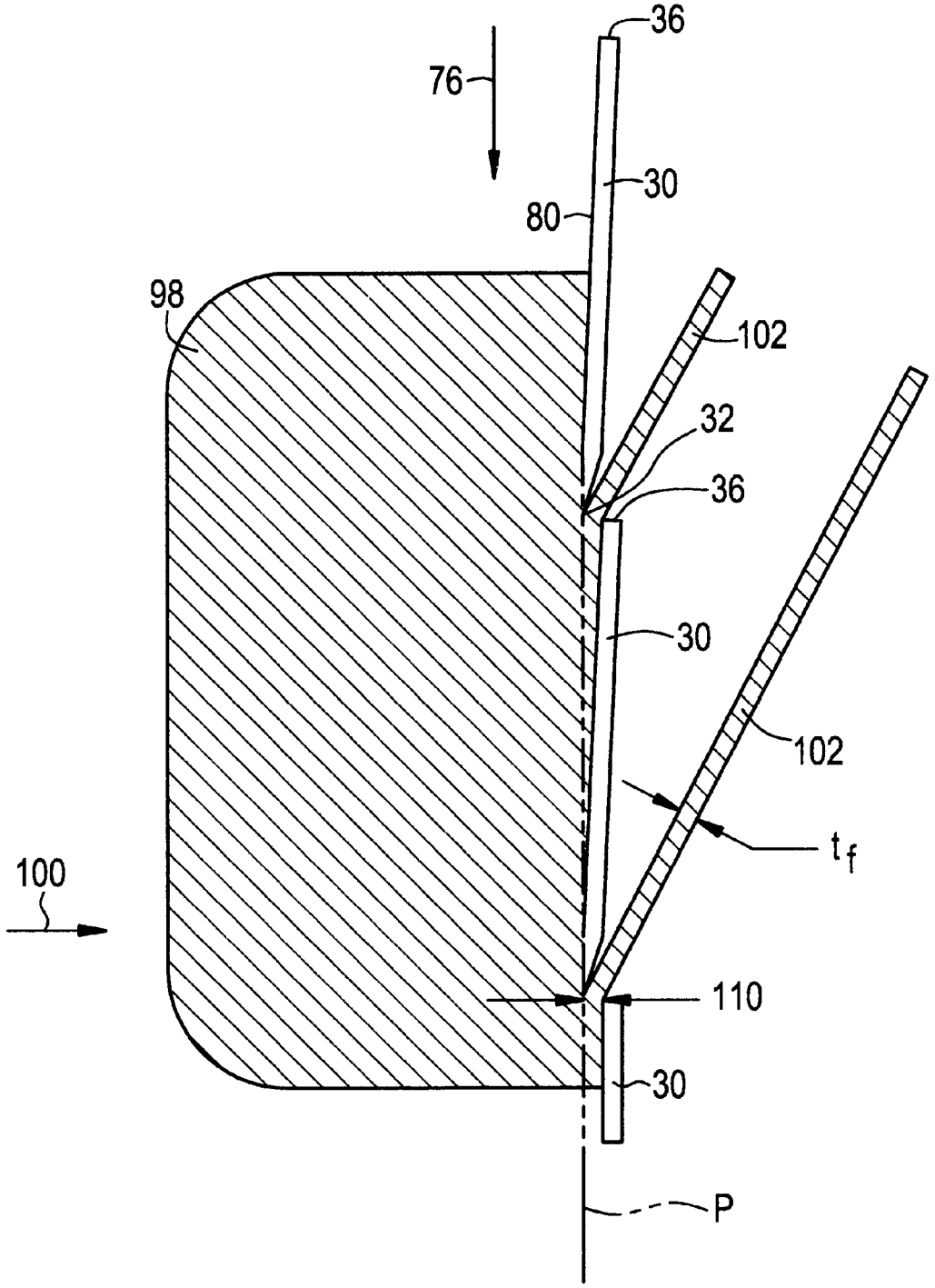
FIG. 17, is a schematic, cross-sectional view illustrating the cutting action of the knives illustrated in FIG. 3.

FIGS. 15 and 16 are cross-sectional views taken along lines XV—XV and XVI—XVI in FIG. 13, respectively. These figures illustrate the rim 74 and the hub 72 to which the opposite ends of the knives 30 are attached and in conjunction with FIG. 17, illustrate how the gate opening is achieved using the single piece knives 30. The rim 74 has a knife attachment surface 104 that extends at a pitch angle θ to the opposite planar sides of the wheel rim 74. Holes 74*a* and 74*b* extend through the attachment surface 104 and are aligned with holes 40*a* and 40*b* of the knife 30. Fasteners (not shown) inserted through the respective holes attach the rim end of the knife 30 to the rim 74. Similarly, hole 106 formed in the hub 72 is aligned with hole 38 of the knife 30 and a fastener inserted through the respective holes attach the hub end of the knife 30 to the hub 72. Hub 72 has an attachment surface 108 configured to accommodate the hub end of the knife 30, the surface 108 extending at a pitch angle θ' with respect to the opposite parallel faces of the hub 72. The depth $d_1$ measured at the rearmost extremity of the surface 104 is equal to the corresponding depth $d_2$ measured at the rearmost extremity of the surface 108 to insure that the second edges 36 of the knives 30 are spaced from the cutting edges 32 of adjacent knives to form the gate openings.

FIG. 17 schematically illustrates the cutting action of the knives 30 as they pass through the food product 98. The cutting plane of the cutting wheel is schematically illustrated at P and the knives 30 move in the direction of arrow 76 as the food product 98 is fed in the direction of arrow 100 through the cutting plane P. As can be seen, the gauging surfaces 80 of each of the knives 30 extends at an angle to the cutting plane P such that the distance between the cutting edge 32 of one blade and the juncture between the gauging surface 80 and the second edge 36 of an adjacent blade in a direction generally perpendicular to the cutting plane P forms the gate opening 110. The dimension of the gate opening 110 is substantially constant along the radial dimensions of the knives between the hub and rim. This dimension will accurately control the thickness $t_f$ of each of the food product slices 102.

Figure 18:
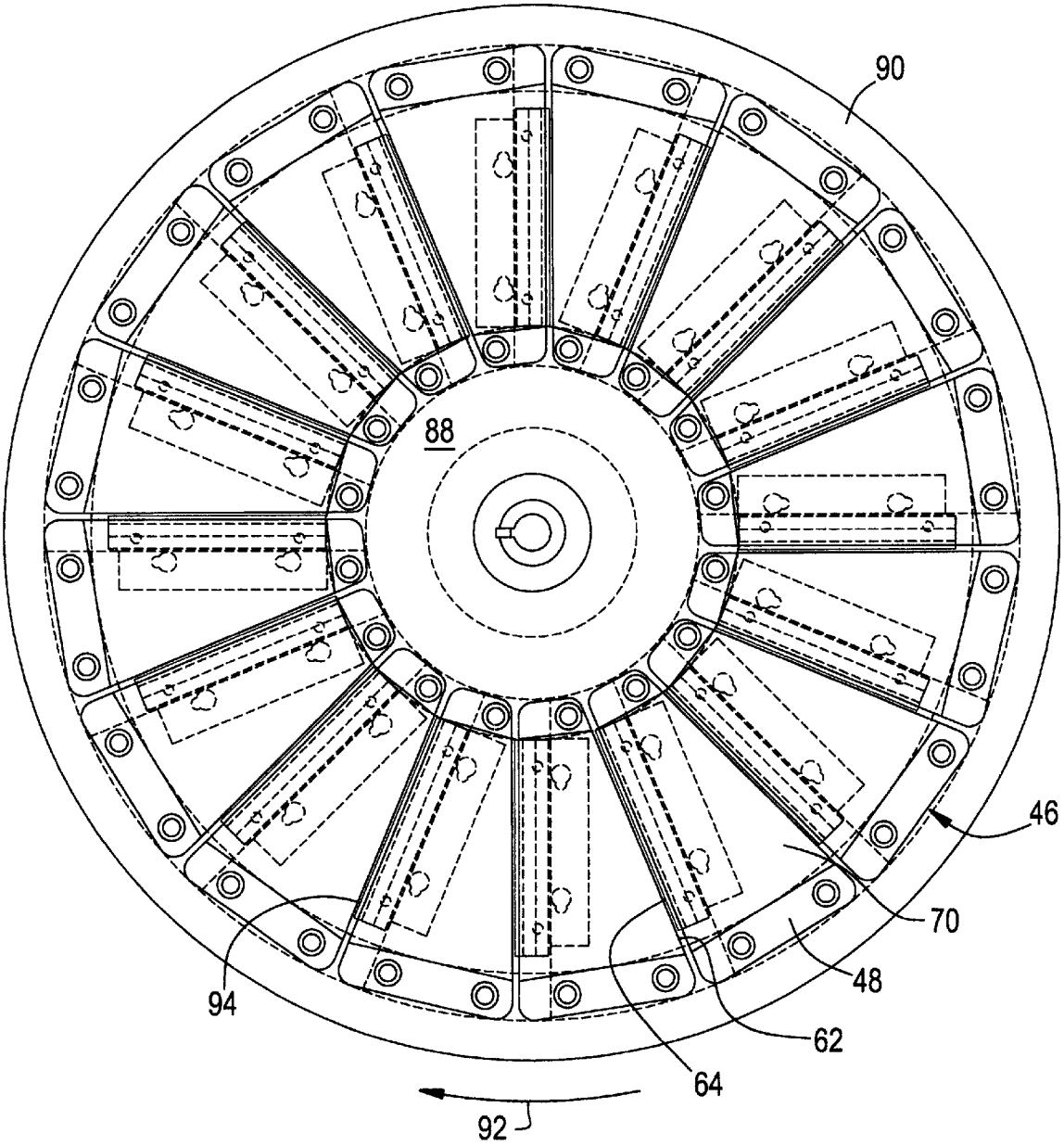
FIG. 18 is a front view of a cutting wheel according to the present invention utilizing a plurality of knives illustrated in FIG. 7.

FIG. 18 is a front view illustrating a cutting wheel having a plurality of knives 46 attached thereto. Again, the cutting wheel comprises a hub 88 and a rim 90 to which the knives 46 are attached. As in the previously described illustrations, the cutting wheel rotates in the direction of arrow 92. A space 94 is formed between the second edge 62 of one knife 46 and the cutting edge 64 of an adjacent knife 46 such that the space 94 has a substantially constant circumferential dimension throughout its radial length. The constant dimensions of the spaces 94 enable the food product to be sliced with increased accuracy than the known cutting wheels.

Figure 19:
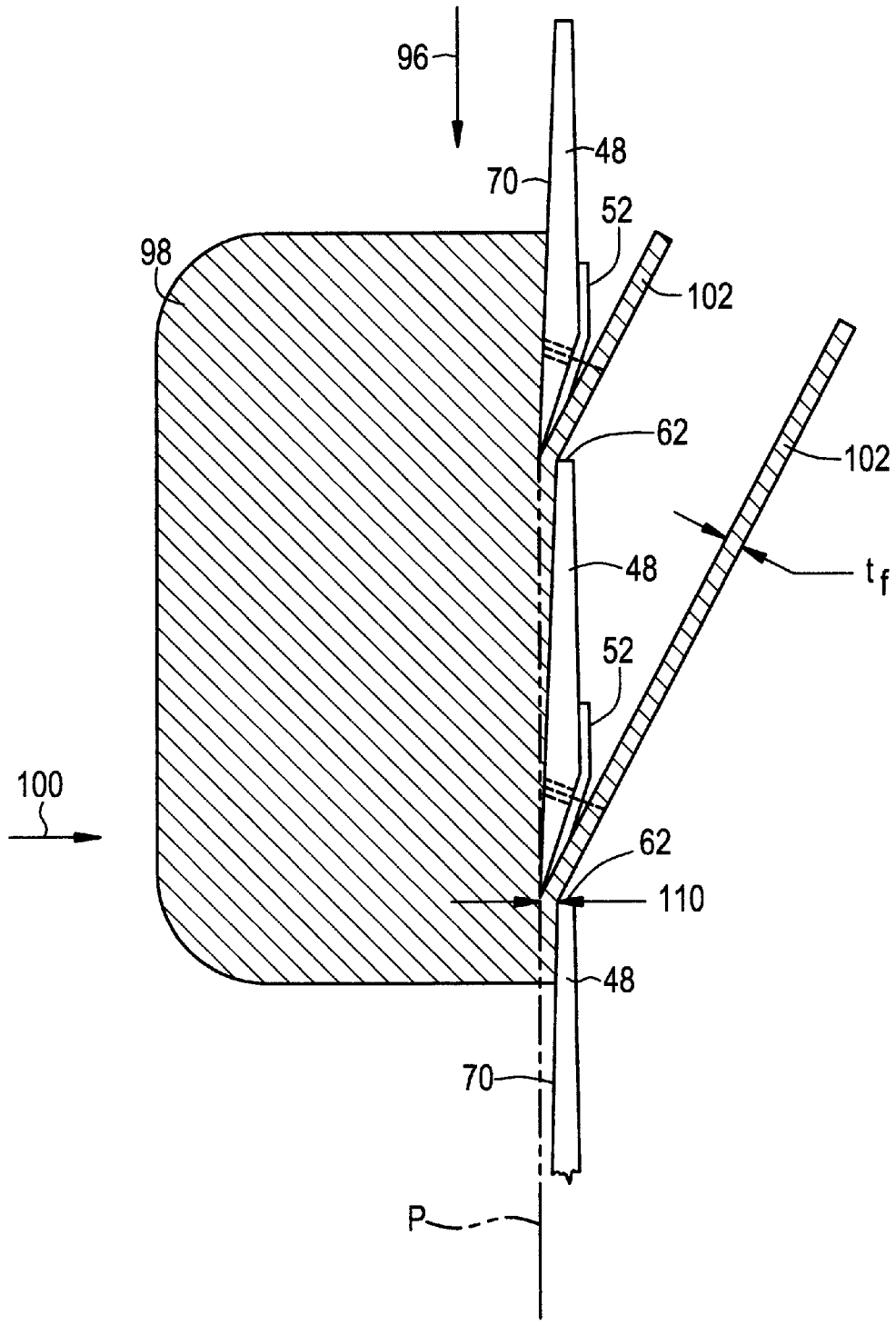
FIG. 19 is a schematic, cross-sectional view illustrating the cutting action of the knives illustrated in FIG. 7.

The cutting action of the knives 46 passing through the food product is schematically illustrated in FIG. 19. The cutting plane of the cutting wheel is schematically illustrated at P and the knives move in the direction of arrow 96 as the food product 98 is fed in the direction of arrow 100 through the cutting plane P. As can be seen, gate opening 110 is formed by the distance between the cutting edge 64 of one knife blade 50, and the juncture of the gauging surface 70 and the second edge 62 of an adjacent holder 48 measured perpendicular to the cutting plane P. Gate opening 110 accurately controls the thickness $t_f$ of each of the food product slices 102. The dimension of the gate opening 110 is substantially constant throughout the radial length of the knife blade 50.

The foregoing description is provided for illustrative purposes only and should note be construed as in any way limiting this invention, the scope of which is defined solely by the appended claims.

I claim:

1. A rotatable cutting wheel for cutting slices from food products advanced towards the wheel in a feed direction, the cutting wheel having a hub (72,82), a rim (12) and comprising a plurality of knives (30,46) each having a leading edge facing a direction of rotation of the wheel and extending generally radially from the hub to the rim, each knife having a gauging surface (70,80) facing opposite said feed direction, a cutting edge (32,64) on the leading edge of the knives and a second edge (36,62) on the trailing edge of the knives with respect to the direction of wheel rotation forming a juncture with the gauging surface, the juncture extending substantially parallel to and spaced in the food product feed direction from the cutting edge of the next adjacent knife located in a trailing direction so as to form a gate opening (110) therebetween, the gate opening being substantially constant and determining a thickness of the sliced food product engaging the knives while the wheel is rotated to advance the cutting edges in a cutting plane.

2. The cutting wheel of claim 1 wherein the gauging surface extends between the cutting edge and the second edge.

3. The cutting wheel of claim 1 wherein each knife is substantially triangular in configuration.

4. The cutting wheel of claim 1 wherein each knife is wider at its rim end than at its hub end.

5. The cutting wheel of claim 4, wherein each knife includes rim and hub mounting holes at opposed ends thereof.

6. The cutting wheel of claim 1 wherein each knife comprises:

a) a knife holder (48) having the second edge (62) and the gauging surface (70) thereon; and, b) a knife blade (50) attached to the knife holder, the knife blade having a cutting edge (64) thereon located at said leading edge.

7. The cutting wheel of claim 6 further comprising a clamp member (52) connected to the knife holder so as to removably clamp the knife blade onto the knife holder.

8. The cutting wheel of claim 6 wherein the knife holder is attached to and extends between the hub and the rim, the width of the knife holder at the hub being less than the width of the knife holder at the rim.

9. The cutting wheel of claim 8, wherein a thickness of the knife holder at the second edge is less than a maximum thickness of the knife holder.

10. The cutting wheel of claim 9 wherein the thickness of the second edge of the knife holder is substantially constant along the length of the knife holder.

* * * * *